United States Patent [19]

May

[11] Patent Number: 4,821,902

[45] Date of Patent: Apr. 18, 1989

[54] WASTE CONTAINER

[75] Inventor: Robert A. May, Beeville, Tex.

[73] Assignee: May Fabricating Co., Inc., Beeville, Tex.

[21] Appl. No.: 176,678

[22] Filed: Apr. 1, 1988

[51] Int. Cl.[4] ..... B65D 43/20

[52] U.S. Cl. ..... 220/1 T; 220/331; 220/329; 414/411

[58] Field of Search ..... 220/1 T, 331, 329, 332; 414/411, 684.3

[56] References Cited

U.S. PATENT DOCUMENTS

| | | | |
|---|---|---|---|
| 2,201,161 | 5/1940 | Deans . | |
| 2,292,092 | 4/1942 | Shankweiler . | |
| 2,338,477 | 1/1944 | Wolters et al. | 312/189 |
| 2,569,254 | 9/1951 | Page | 312/272 |
| 2,661,119 | 9/1952 | Spiess | 220/335 X |
| 2,758,744 | 8/1956 | Spindler et al. . | |
| 3,197,060 | 8/1963 | Farniok | 220/331 X |
| 3,961,723 | 6/1976 | Eckel | 220/331 |
| 4,320,852 | 3/1982 | Nagelkirk | 220/331 |
| 4,653,662 | 3/1987 | Wise | 220/I T X |

*Primary Examiner*—Stephen Marcus
*Assistant Examiner*—Gilbert W. Reece
*Attorney, Agent, or Firm*—Vaden, Eickenroht, Thompson & Boulware

[57] ABSTRACT

There is disclosed a waste container having a large access opening in its top wall and a lid which may be raised and guidably moved by a person located on one side of the container between a position closing the opening and an upright position adjacent the side wall of the container.

9 Claims, 5 Drawing Sheets

WASTE CONTAINER

DESCRIPTION OF THE RELATED ART

This invention relates in general to a waste container having a body with a top access opening adapted to be closed by a removable lid. More particularly, it relates to improvements in containers of this type in which the waste is to be transported and hence which are quite large and heavy.

One such type of container is so constructed as to permit it to be rolled onto the pivoted bed of a truck for transport with the truck to a waste disposal site, and then, when the waste has been deposited at the site, transported to another location and rolled off of the bed at that location in order that it may be again filled with waste. In addition, the container body often has an upstanding rim about its top access opening to prevent drainage into the container body, and the lid has a depending lip to surround the rim and a gasket to form a seal with respect to the container body when the lid is closed. Hence, the lid must be raised in order to lift its lip above the rim before it can then be moved to a location out of the way of the top access opening.

These and other containers are often used in an environment in which there is only one person available for moving the lid into or from a position above the top access opening. Thus, because of its size and weight, the lid may have to be formed in two or more sections, each of a size and weight that one person may handle, and, in this latter case, a supporting member must span the top access opening to support adjacent edges of the sections. This of course complicates the construction of the container and limits the free space through the access opening. Also, in order to allow access to either side for loading purposes, the lid must, in many cases, be capable of being stored on either side of the container body.

SUMMARY OF THE INVENTION

The object of this invention is to provide a waste container of this type which is especially well suited for such use, and, more particularly, which has a lid which may be moved between closed position and a position to one, and preferably either, side of the container by a single person located at that one side.

This and other objects are accomplished, in accordance with the illustrated embodiment of the present invention, by a waste container of the type described having a heavy metal body in which the waste is to be contained, a lid of fiberglass reinforced plastic or other lightweight material for closing the access opening in the top wall of the body, and means by which a single person may move the lid between a position above the opening and a stored position adjacent one side wall of the body. Thus, the means for so moving the lid includes means for raising and lowering the lid between its closed position and a raised position in which the lip of the lid is above the rim about the access opening in the top wall of the container, and for supporting the lid, when so raised, for guided, lateral movement toward and away from a position overhanging a side of the body, together with means engagable with the lid, as it is so moved into overhanging position, to permit it to be swung into its upright, suspended position, and then to be swung back into its overhanging position for guided lateral movement to a position above the opening from which it may then be lowered to closed position. More particularly, in the preferred and illustrated embodiment, the means for supporting the lid enables it to be glidably moved toward and away from a position overhanging either side of the container body, and a means is provided for engaging with or disengaging from the lid, when moved to either side so as to permit it to be swung into or out of a suspended position on either side of the container body.

In the illustrated and preferred embodiment of the invention, the lid includes a flange which extends outwardly from each end, and the means for raising and lowering it comprises a frame connected to the top wall of the container beneath each flange by a parallelagram linkage having a handle at the side of the container body. More particularly, the lid carries a deformable seal ring to engage the rim of the body, and the frame has means thereon to hold the lid down and maintain the seal ring deformed as the linkage moves over a dead center position during lowering of the lid. The linkage is also of such construction as to hold the lid frame in its raised position following travel over another dead center position as the lid is raised.

In the preferred and illustrated embodiment of the invention, a hanger is pivotally connected to the body in position to be engaged by the lid, as the lid moves laterally of the body, and thus support the lid from the hanger for swinging therewith into its upright, suspended position along said one side. More particularly, the hanger is yieldably urged to a position in which it is engaged by the lid, so that, following return of the lid to its closed position, the hanger is positioned to be engaged by the stop on the lid as the lid is again moved to its open position.

BRIEF DESCRIPTION OF THE DRAWINGS

In the drawings, wherein like reference characters are used throughout to indicate like parts.

DESCRIPTION OF THE PREFERRED EMBODIMENT

Figure 1:
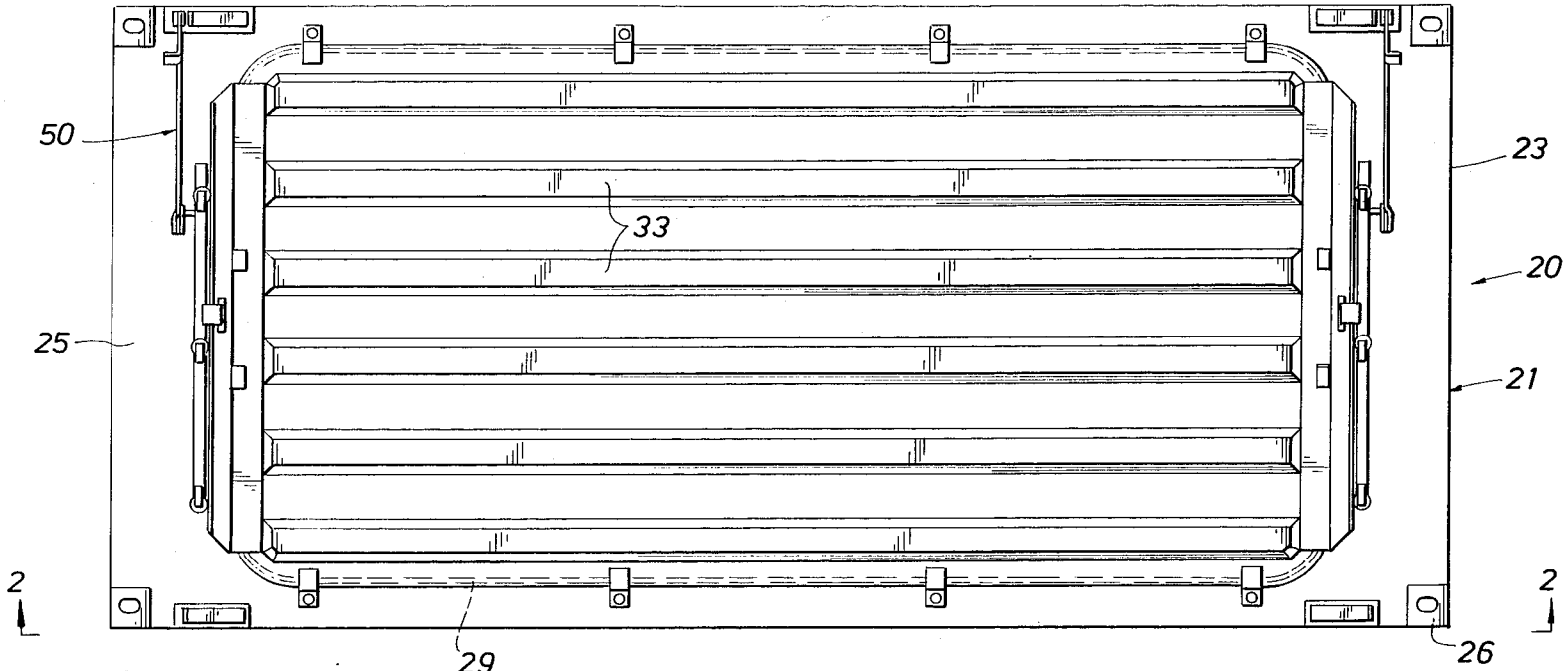
FIG. 1 is a top plan view of the container showing the lid thereof in closed position.
Figure 2:
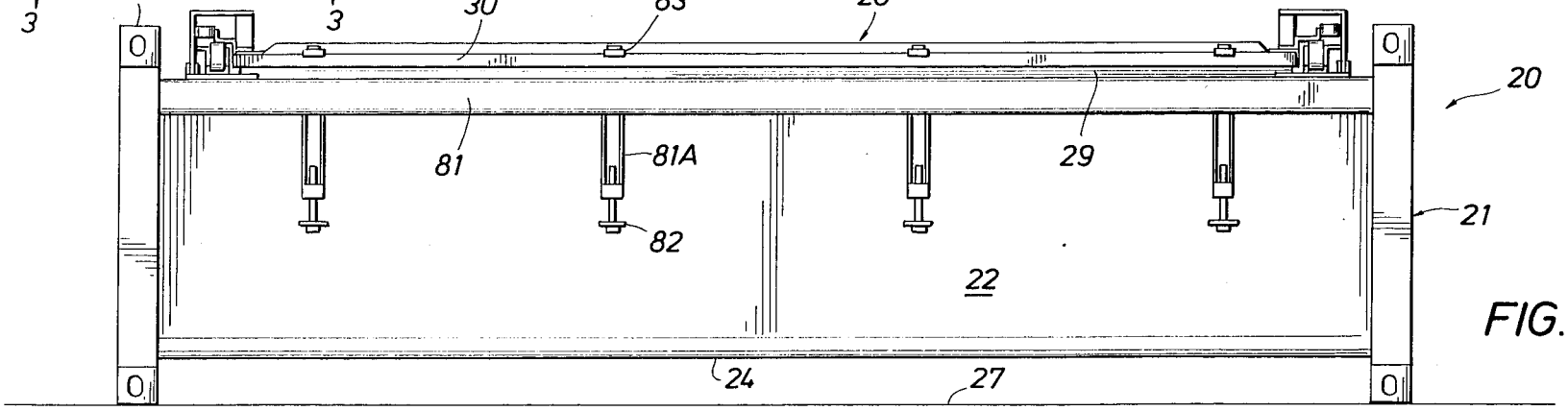
FIG. 2 is a side elevational view of the container, as seen along broken lines 2—2 of FIG. 1.
Figure 3:
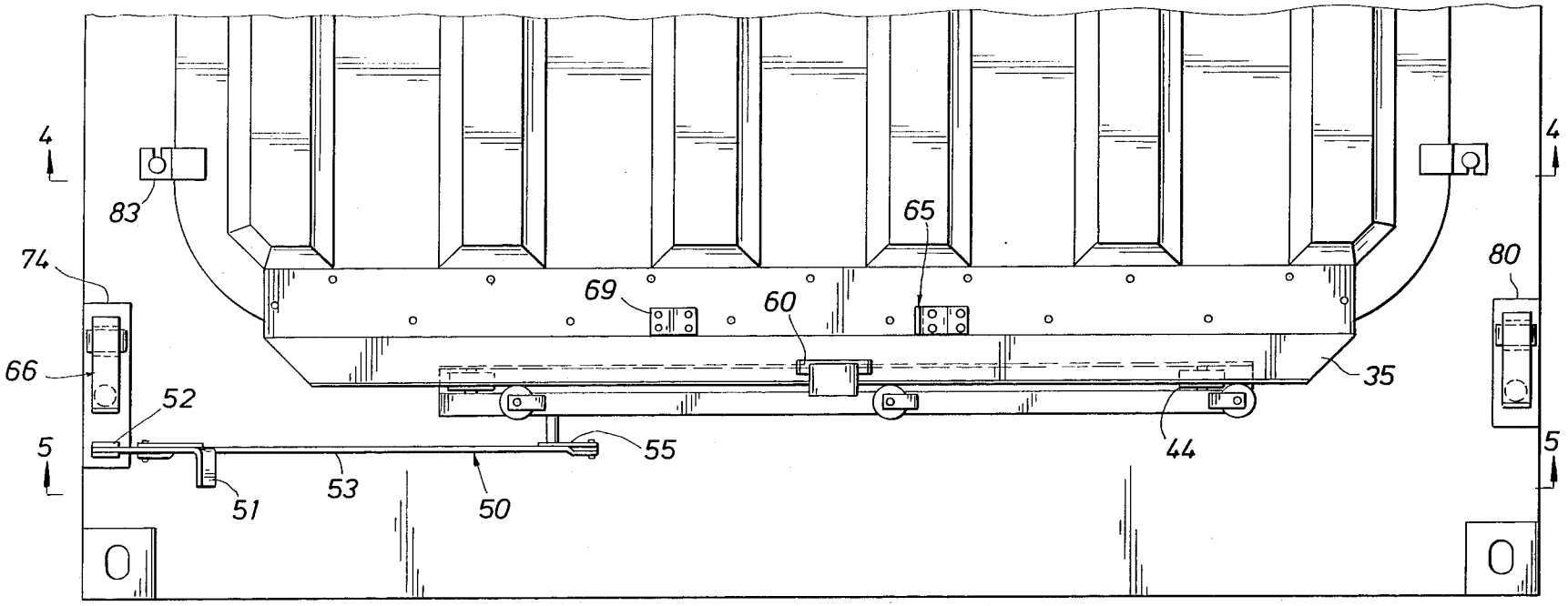
FIG. 3 is an enlarged top plan view of one end of the container, as seen along broken lines 3—3 of FIG. 2.
Figure 4:
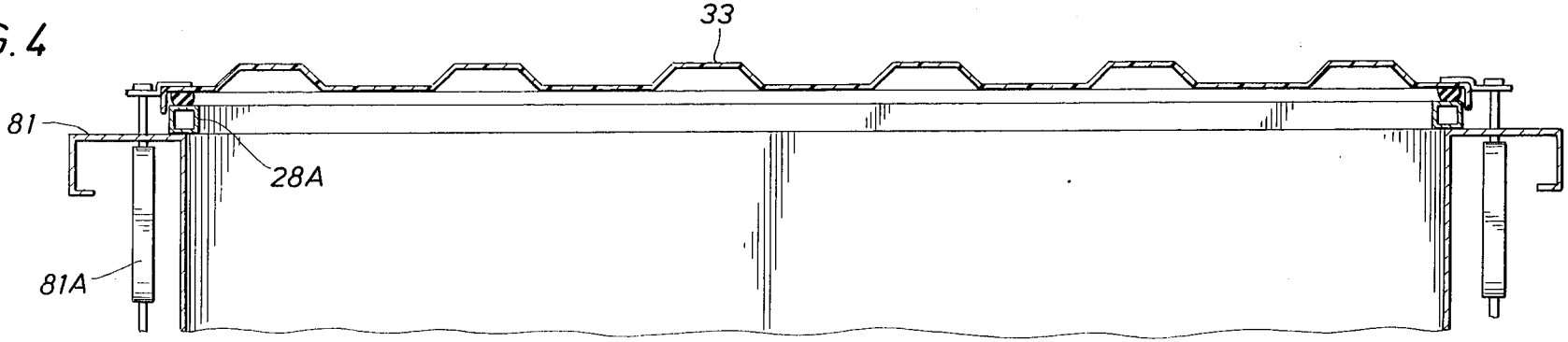
FIG. 4 is a cross-sectional view of the container, as seen along broken lines 4—4 of FIG. 3.
Figure 7:
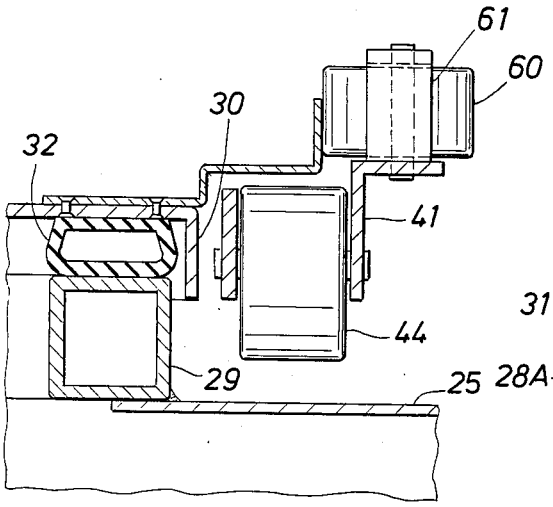
FIGS. 7, 8 and 9 are further enlarged crosssectional views of the means by which the lid is raised and lowered between the positions of FIGS. 5 and 6 and supported in its raised position for guided movement laterally toward one side of the container, FIGS. 7 and 8 being taken along broken lines 7—7 and 8—8 of FIG. 5 and FIG. 9 being taken along broken lines 9—9 of FIG. 6.
Figure 8:
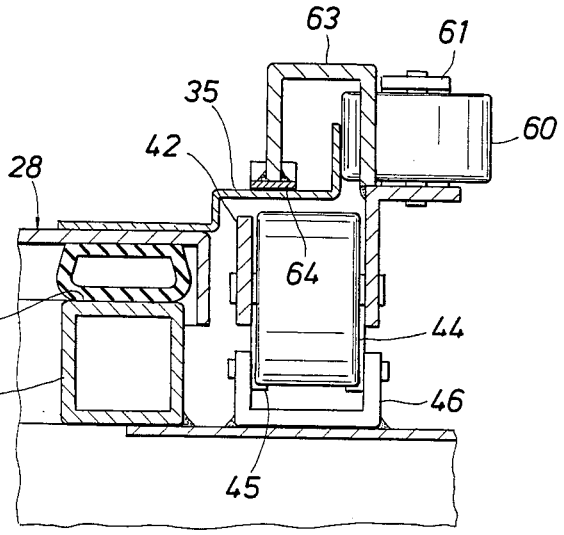

With reference now to the details of the above-described drawings, the waste container, which is indicated in its entirety by reference character 20, is shown in FIGS. 1 and 2 to comprise a body 21 having side walls 22, end walls 23, a bottom wall 24 and a top wall 25. The body has columns 26 at its four corners to support it above ground level 27, and an access opening 28A in its top wall 25 which is adapted to be closed by a lid 28. More particularly, the top wall of the container body has an upstanding rim 29 which surrounds the access opening 28A, as shown in FIGS. 4 and 7 and 8, and the lid 28 has a depending lip 30 for disposal about the rim when the lid is in its closed position. As best shown in FIGS. 7 to 10, the rim 29 comprises square tubing having a relatively wide upper surface 31, and a deformable seal ring 32 is mounted on the lower side of lid 28 to engage the upper side 31 of the rim when the lid is in the closed position of FIGS. 7 and 8.

As shown, and as previously described, the access opening 28A is formed through a major portion of the top wall of the container body so as to provide the largest possible access therethrough. However, as a result of an opening of this size, particularly in a typical waste container, a lid of conventional metal construction would be so heavy as to not permit its manipulation by a single person. Hence, and as also previously noted, the lid is instead formed of fiberglass reinforced plastic or other lightweight material. To provide it with the necessary rigidity and strength to span the access opening, it is provided with ribs 33 which extend substantially from one end to the other.

The lid also includes a flange 35 extending from each of its ends to overhang a portion of the top wall 25 of the container body outwardly of the rim 29 along each end of the access opening 28A. As best shown in FIG. 7 to 10, the flange 35 is riveted or otherwise secured to the top wall of the lid and is bent to provide a downwardly facing support surface 36 as well as an outwardly facing guide surface 37, both extending laterally along the flange.

Figure 9:
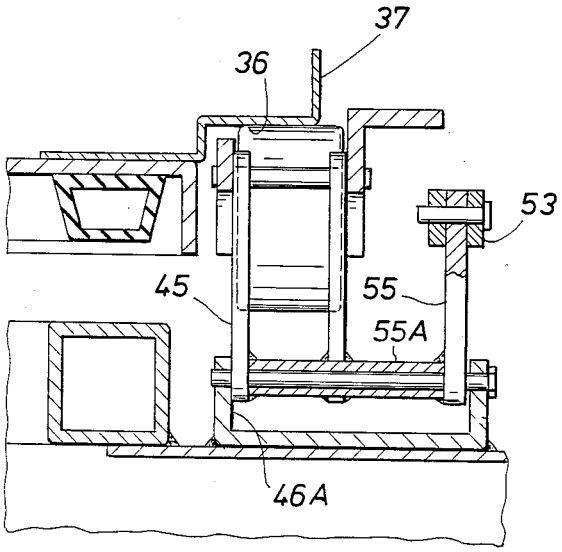

As previously described, the lid is adapted to be raised and lowered by a frame pivotally supported on the top wall of the body beneath the flange at each end. As shown, each frame, which is indicated in its entirety by reference character 40, comprises a pair of laterally extending beams 41 and 42 connected at their opposite ends by end walls 43 and rollers 44 mounted on pins extending between the beams 41 and 42 near each end and generally the mid point of the beams. More particularly, and as best shown in FIGS. 7, 8 and 9, each roller is positioned beneath the support surface 36 of the adjacent lid flange.

Each frame is pivotally connected to the top wall of the container body adjacent the ends of the access opening therein by means of links 45 pivotally connected at their lower ends to pins mounted on trunnions 46 and 46A welded to the upper side of the top wall 25 and pivotally connected at their opposite ends to pins extending between the beams 41 and 42 of the frame. The links are of equal length so as to form a parallelogram linkage with the beams adapted to maintain the rollers of the frame parallel to the top wall of the container body as the frame is raised and lowered. More particularly, the links are of such extent that when swung upwardly to the upright positions of FIG. 6, they lift the lip 30 of the lid above the rim 29 about the access opening, whereby the lid may be moved laterally of the container body, as will be described to follow.

Figure 5:
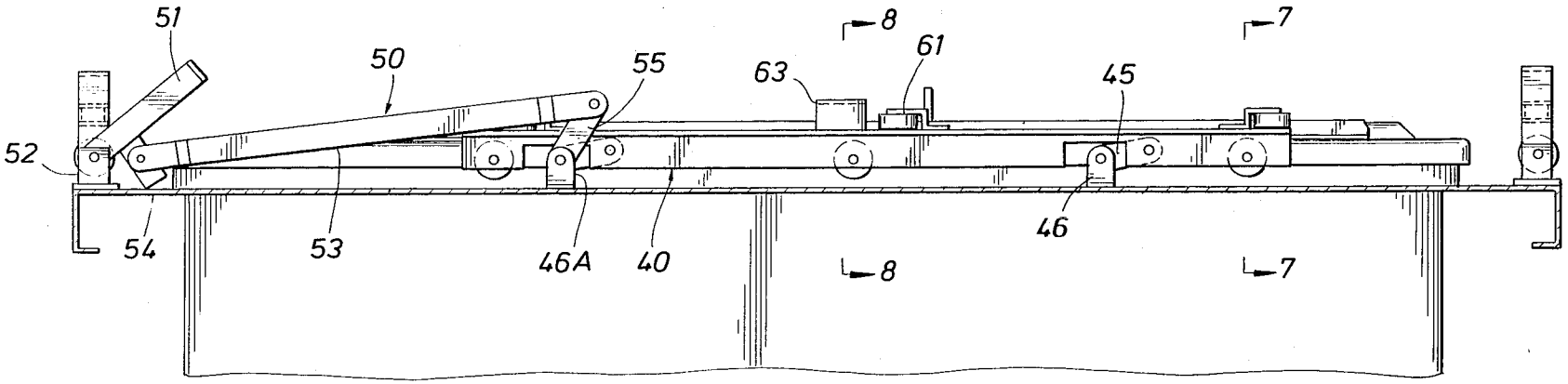
FIGS. 5 and 6 are further enlarged cross-sectional views of the container, as seen along broken lines 5—5 of FIG. 3, and showing the lid in its closed position in FIG. 5 and open position in FIG. 6.
Figure 6:
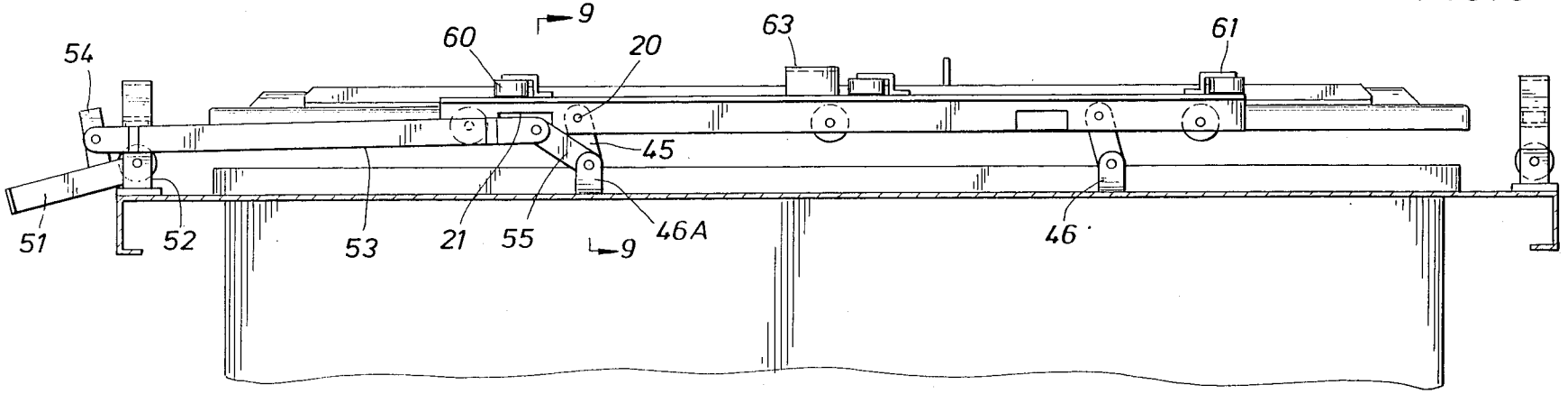

The parallelogram linkage is moved between the positions of FIGS. 5 and 6, so as to raise and lower the lid, by means indicated in its entirety by reference character 50 and including a crank arm or handle 51 pivotally mounted on a trunnion 52 welded to a plate on the top wall of the container body near the edge of the left side thereof, as shown in FIGS. 5 and 6, and to be described to follow. As shown, the crank also includes a long link 53 extending laterally of the container and pivotally connected at one end to a bracket 54 welded to the side of the handle 51, and at its opposite end to a short link 55. As shown in FIG. 9, the link 55 is in turn welded to a sleeve 55A which surrounds a pin extending between trunions 46A and which is also welded to links 45 pivotally connected to the frame. Thus, a person standing to the left side of the container, as shown in FIGS. 5 and 6, may swing the handle clockwise to the position of FIG. 5 so as to lower the lid to its closed position, or counter-clockwise from that position to the position shown in FIG. 6 in order to raise the lid.

As the crank arm 51 is swung in a clockwise direction, as seen in FIG. 5, the seal ring 32 of the lid will be lowered into engagement with the top surface 31 of the rim 29 to support the lid thereon. As best shown in FIG. 8, a bracket 63 mounted on each frame near its mid point carries a bearing pad 64 above a horizontally extending portion of the flange of the lid, so that, as the arm 51 continues to be swung in a clockwise direction, the pad will engage the flange and thus lower it to deform the seal ring. During final swinging of the arm, the axis of the pin connecting it to the bracket 54 moves over "dead center" from above to below an imaginary line extending between the pins mounting the arm on the trunnions 52 and the pin connecting the links 53 and 55. As a result, when the bracket 54 engages the top wall of the container body, as shown in FIG. 5, the deformed seal ring provides a force holding the crank in its over center position and thus the lid in its closed, sealed position.

On the other hand, when the linkage is in the position of FIG. 6 to raise the lid, the pivot pins connecting the upper ends of links 45 to the lid have moved over "dead center" from the right to a position to the left of imaginary lines extending vertically through the pins connecting the links to the container body. Thus, when the pin 51 engages the aforementioned plate on the top side of the body, as shown in FIG. 6, the lid is held in raised position.

Since the operator need not continue to hold the handle 51 in the position of FIG. 6, he is free to grasp the side edge of the lid and cause it to slide laterally over the support rollers 44 of the frame. During this lateral sliding movement over the frame, the lid is prevented from moving longitudinally by the engagement of guide rollers 60 mounted on the frame with the outer guide surfaces 37 of the flanges of the lid. As shown in FIGS. 7, 8 and 9, these rollers are mounted on pins journaled within brackets 61 mounted on the beam 41 of the frame. As shown in FIGS. 5 and 6, there are three such guide rollers, located near each end of the frame as well as generally the mid point of the frame.

Figure 11:
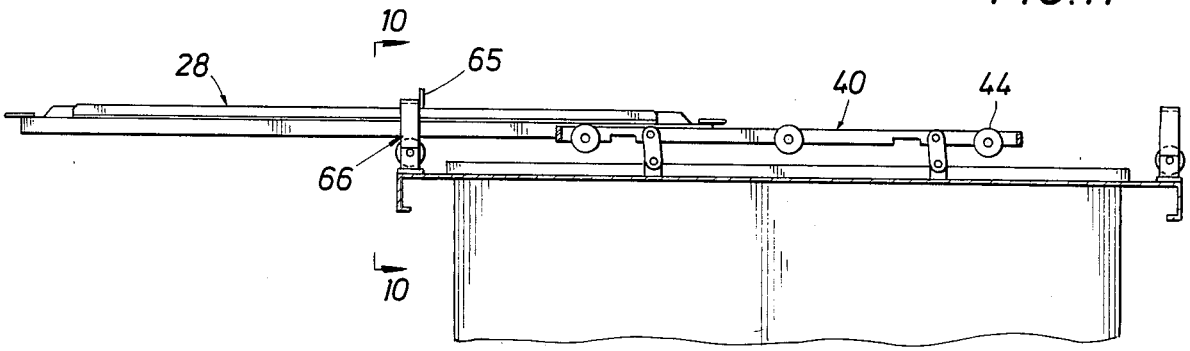
FIG. 11 is a view from one end of the container with the lid guidably moved laterally to a position overhanging one side of the container and with a stop on the lid engaged with an upstanding hanger mounted on the top wall of the container body near its one side.
Figure 12:
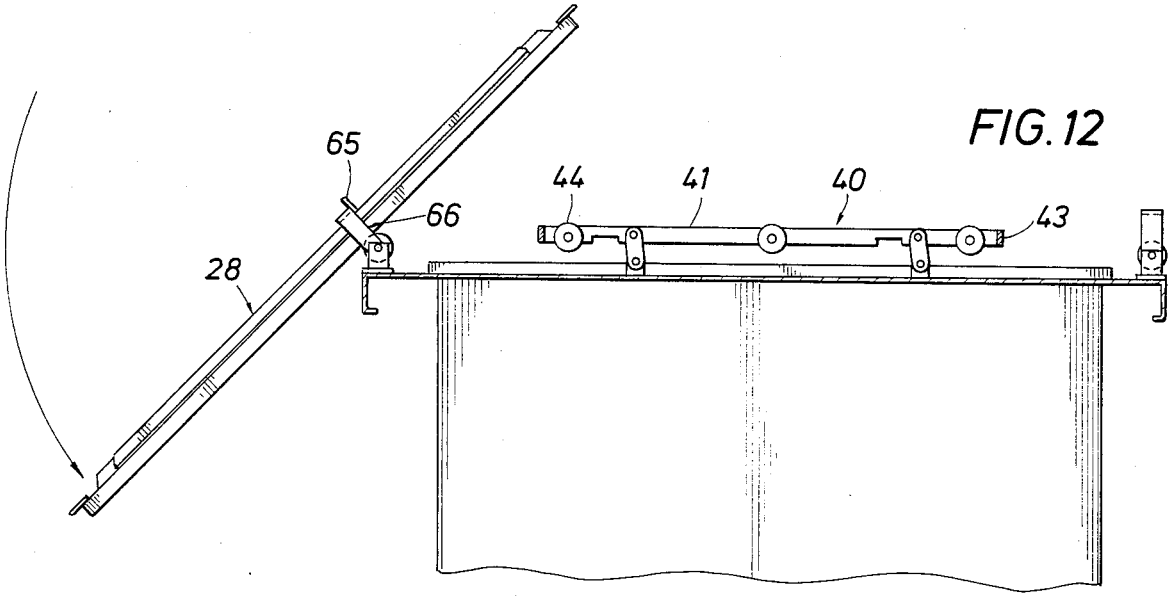
FIG. 12 is a further end view of the container, similar to FIG. 11, but upon swinging of the lid with the hanger to lower its overhanging portion toward stored position adjacent the one side of the container.

A hanger 66 is mounted on the top wall of the container body adjacent each side of the container in position to be engaged by the stop 65 on the lid during lateral movement of the lid toward the overhanging position of FIG. 11. More particularly, the stop 65 is disposed to the right of the mid point of the lid from side to side so as to engage the hanger 66 when a major portion of the lid is overhanging the side of the container. The hanger is pivotally mounted on the container body for swinging about a longitudinally extending axis near the corner of the side and top walls of the container body. Thus, continued movement of the lid in an outward direction will cause the hanger to swing in a counterclockwise direction, as shown in FIG. 12, and the lid to swing with it due to the support of its stop 65 from the hanger.

Figure 13:
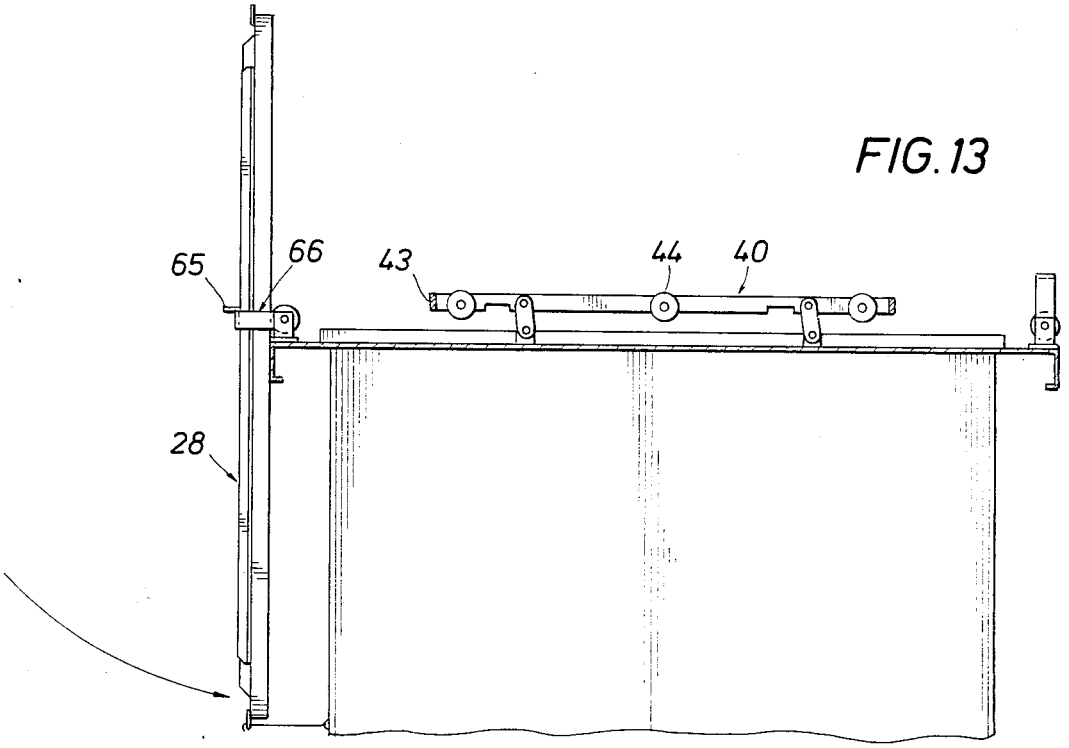
FIG. 13 is a further view similar to FIGS. 11 and 12, but upon continued swinging of the lid into an upright position suspended adjacent the one side of the container.

More particularly, the person who has pulled the lid to its overhanging position may maintain his grasp on the lid to control its swinging downwardly under its weight to the position shown in FIG. 13 in which it is suspended adajcent the side wall of the container. As shown, the lid is located in this position by engagement of its lower side with the side edge of an overhanging portion of the top wall of the container body. Due to the dependency of the major portion of its weight, the lid will remain suspended in this position so as to provide full access to the opening in the top wall of the container until such time as it is desired to again close the opening.

Figure 10:
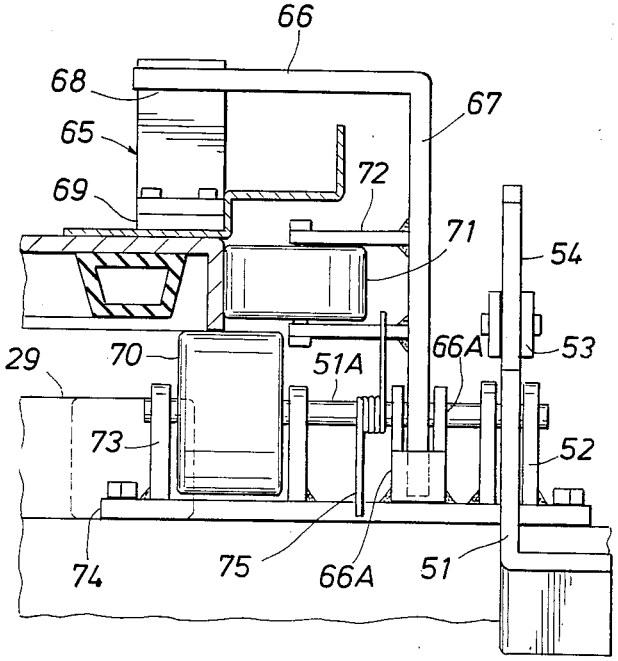
FIG. 10 is an enlarged detailed view, as seen along broken lines 10—10 of FIG. 11, of the means on which the lid is supported as it is moved laterally to a position overhanging one side of the container.

As best shown in FIG. 10, the hanger 66 is pivotally mounted on the same pin about which the handle 51 is pivotally mounted, which pin is additionally journaled in trunnions 66A mounted on the top wall of the container body inboard of trunnions 52. As also best shown in this figure of the drawings, the hanger comprises an "L" shaped member having an upright arm 67 whose lower end is pivotally mounted on the pin and a longitudinally extending arm 68 which projects into the path of the stop 65. The stop has a lower end which is bolted to a plate 69 connected to the top side of the portion of the flange 35 on the end of the lid which is connected to the top wall of the lid 28. Another roller 70 is mounted on the top wall of the container body in position to support the lid as the lid moves guidably over the frame 40. That is, as shown in FIG. 10, the roller 70 is of such size and so located as to engage the lower edge of the lip 30 on the lid as the left end of the lid approaches the hanger as it is moved to the left.

During this lateral movement, the lid is also guided in a longitudinal direction by guide rollers 71 carried by pins mounted on trunnions 72 welded to the side of the arm 67 of the hanger 66. As shown in FIG. 10, the roller 71 is of such size and is so located as to engage the outer side of the depending lip 30 on the lid as the side of the lid moves into a position beneath the hanger and thus onto the roller 70.

As best shown in FIG. 10, the roller 70 is mounted on the top wall of the container body by means of the pin 51A which extends through trunnions 73. As also shown in FIG. 10, the trunnions 73 as well as the trunnions 52 and 66A are welded to the upper side of a mounting plate 74 bolted or otherwise secured to the top wall of the container.

The hanger is normally disposed in the upright position of FIG. 11, and thus in a position to be engaged with the stop 65, by means of a spring 75 wound about the pin and having its opposite ends biased against an outer edge of the mounting plate 74 and an outer edge of one of the trunnions 72. Although being of sufficient strength to normally maintain the hanger 66 in an upright position, the spring will yield to the weight of the overhanging portion of the lid so as to permit the hanger and thus the lid to swing in a clockwise direction, as shown in FIG. 12. On the other hand, as the lid is returned to its closed position, and thus swung in a clockwise direction from the position of FIG. 13 to the position of FIG. 11, the hanger will be returned in its upright position as the lid is then moved laterally and guidably over the roller 70 onto and over the rollers 44 of the frame 40.

The pivotal mounting of the hanger 66, as well as the disposal of a substantial portion of the weight of the lid on the right side of the pivotal axis of the hanger, enables a single person to lift the depending end of the lid from the position of FIG. 13 and through the position of FIG. 12 into the position of FIG. 11, at which time that person need only move the lid guidably in a lateral direction to transfer its entire support from the roller 70 onto the rollers 44 of the frame 40. In like manner, the handle 51 may be manipulated by that person to release and lower the frame from its raised position to its lowered position, and then to hold it in that lowered position as the pin connecting link 53 and bracket 54 moves over a dead center position.

As shown in FIG. 13, when in its upright suspended position adjacent one side of the container body, the lid occupies a minimum of space between the container and anything which might be to that side of it. On the other hand, there may be occasions in which it is easier or only possible to store the lid on the opposite side of the container—i.e., on the right side as seen in FIGS. 11 to 13. For this purpose, hangers 66 are also mounted on that side adjacent each end of the container, and stops 65, or ones similar thereto, are adapted to be mounted in an alternate position on opposite ends of the lid for engaging the hanger as the lid is guidably moved into a position overhanging the right side of the container. Thus, a mounting plate 69 for the stop is so located as to mount the stop in a position to the left of the mid point of the lateral dimension of the flange and thus the lid. Thus, as in the case of the stop adapted to support the lid as it is moved to the left, it will be engaged by that hanger only after a major portion of the lateral dimension of the lid has been moved beyond the hanger and thus overhangs the right side of the container body.

More particularly, additional parts for guidably supporting the lid during its movement toward the right side of the container are mounted on plates 80 mounted on the top side of the top wall of the container body near each end thereof. These parts include, of course, support rollers 70 and guide rollers such as guide rollers 71 mounted on arm 67 which is supported by trunnions 66A on the mounting plate in a manner similar to the mounting of such parts along the left side of the container. In this case, however, the mounting plate 80 is somewhat shorter than the mounting plate 74 since it does not also have to accommodate and support the handle 51 for the crank 50, which instead is disposed only on the left side of the container, as shown in FIGS. 11 to 13.

As best shown in FIGS. 4 and 11 to 13, the vertical portions of the walls 22 are spaced inwardly from the outer sides of the corner columns or posts 21 and thus inwardly from overhanging flanges 81 along the upper ends of the side walls. As best shown in FIGS. 2 and 4, turnbuckles 81A or similar means extend along the sides of the container body and are releasably supported at their lower ends by brackets 82 on the side walls 22 and releasably connected at their upper ends to brackers 83 on the sides of the lid so as to hold the lid downwardly in its closed position. The upper ends of the turn buckles extend through slots formed in the upper brackets, and the brackets may be swung into positions releasing the enlarged upper ends of the turn buckles so as to permit the lid to be removed from closed position.

From the foregoing it will be seen that this invention is one well adapted to attain all of the ends and objects hereinabove set forth, together with other advantages which are obvious and which are inherent to the apparatus.

It will be understood that certain features and subcombinations are of utility and may be employed without reference to other features and subcombinations. This is contemplated by and is within the scope of the claims.

As many possible embodiments may be made of the invention without departing from the scope thereof, it is to be understood that all matter herein set forth or shown in the accompanying drawings is to be interpreted as illustrative and not in a limiting sense.

I claim:

1. A waste container, comprising a metal body having longitudinally extending side walls, laterally extending end walls, a bottom wall, and a top wall having a large unobstructed access opening therein which is surrounded by an upstanding rim, a lid of fiberglass reinforced plastic or other relatively light weight material having a downwardly extending lip for disposal about the rim when the lid is over the opening to close same, and means by which the lid may be moved between its closed position and a generally upright, suspended position adjacent either side of the container, including means for raising and lowering the lid between its closed position and a raised position in which its lip is above the rim, and supporting the lid, when so raised, for guided, lateral movement toward and away from a position overhanging either side of the body, and means for engaging the lid, as it is moved into overhanging position, to permit it to be swung into its upright, suspended position, and then to be swung back into its overhanging position for guided lateral movement to a position above the opening, from which it may be lowered to closed position.

2. A waste container of the character defined in claim 1, wherein the lid includes a flange extending outwardly from each end, and the means for raising and lowering the lid comprises a frame and linkage connecting the frame to the top wall of the container body for vertical movement beneath the flange to raise and lower it.

3. A waste container of the character defined in claim 2, wherein the lid carries a deformable seal ring positioned to engage the rim as the lid is closed, and the frame has means thereon which engages the lid to hold it in closed position and the seal ring sealably engaged with the rim as the linkage moves over a dead center position.

4. A waste container of the character defined in claim 3, wherein the linkage is also constructed and arranged to hold the lid in its raised position as the linkage is moved over another dead center position.

5. A waste container, comprising a container body having longitudinally extending side walls, laterally extending end walls, a bottom wall, and a top wall having an access opening therein which is surrounded by an upstanding rim, a lid having a downwardly extending lip for disposal about the rim when the lid is over the opening to close same, and means by which the lid may be moved between its closed position and a generally upright, suspended position adjacent one side wall of the container, including means on the body adjacent each end of the opening for raising and lowering the lid between its closed position and a raised position in which its lip is above the rim, and supporting the rim, when so raised, for guided, lateral movement toward and away from a position overhanging said one side wall of the body, and means for engaging the lid, as it is moved into overhanging position, to permit it to be swung into its upright, suspended position, and then to be swung back into its overhanging position for guided lateral movement to a position above the opening, from which it may be lowered to closed position.

6. A waste container of the character described in claim 5, wherein said means engagable with the lid includes a hanger pivotally connected to the container body near said one side to support the lid for pivoting with the lid into its generally upright, suspended position adjacent the one side wall of the body.

7. A waste container of the character described in claim 6, including means yieldably urging the hanger into a position in which it is so engaged by the lid.

8. A waste container of the character described in claim 6, wherein the lid includes a flange extending outwardly from each end, and the means for raising and lowering the lid comprises a frame at each end pivotally connected to the body for engaging beneath the flange to raise and lower the lid.

9. A waste container of the character described in claim 6, wherein the supporting means includes a roller on the body adjacent the one side thereof to support the lid as it moves off of the frame and into supported position from the hanger.

* * * * *